United States Patent [19]

Muller

[11] Patent Number: 4,506,682

[45] Date of Patent: Mar. 26, 1985

[54] CLEAR TOBACCO AROMA OIL, A PROCESS FOR OBTAINING IT FROM A TOBACCO EXTRACT, AND ITS USE

[76] Inventor: Adam Muller, Dr.
Hans-Schack-Strasse 28, D-8630
Coburg, Fed. Rep. of Germany

[21] Appl. No.: 445,929

[22] Filed: Dec. 1, 1982

[30] Foreign Application Priority Data

Dec. 7, 1981 [DE] Fed. Rep. of Germany ..... 3148335
May 18, 1982 [DE] Fed. Rep. of Germany ..... 3218760

[51] Int. Cl.[3] ..... A24B 15/24; A24B 15/26
[52] U.S. Cl. ..... 131/297; 131/298; 546/280; 252/522
[58] Field of Search ..... 131/297, 298, 309, 310, 131/274, 275; 424/364; 546/280; 260/236.5

[56] References Cited

U.S. PATENT DOCUMENTS 3,390,685 7/1968 Von Bethmann et al. ..... 260/236.5

FOREIGN PATENT DOCUMENTS 2043537 1/1974 Fed. Rep. of Germany .
1106468 3/1968 United Kingdom ..... 131/297
1357645 6/1974 United Kingdom .

*Primary Examiner*—V. Millin
*Attorney, Agent, or Firm*—Ladas & Parry

[57] ABSTRACT

The invention relates to a process for obtaining aromatic materials from a tobacco extract (primary extract) obtainable by means of solvents, by mixing this tobacco extract with an adsorbent, treating the mixture obtained with $CO_2$ in a pressure extraction vessel under extraction conditions (secondary extraction) and isolating a clear tobacco aroma oil in a downstream separating vessel.

The invention also relates to a new tobacco aroma oil which is free of resins, waxes and polyphenols and has a considerably reduced nicotine content.

The invention further relates to the use of the obtainable tobacco aroma oil for aromatizing tobacco or tobacco products.

17 Claims, 1 Drawing Figure

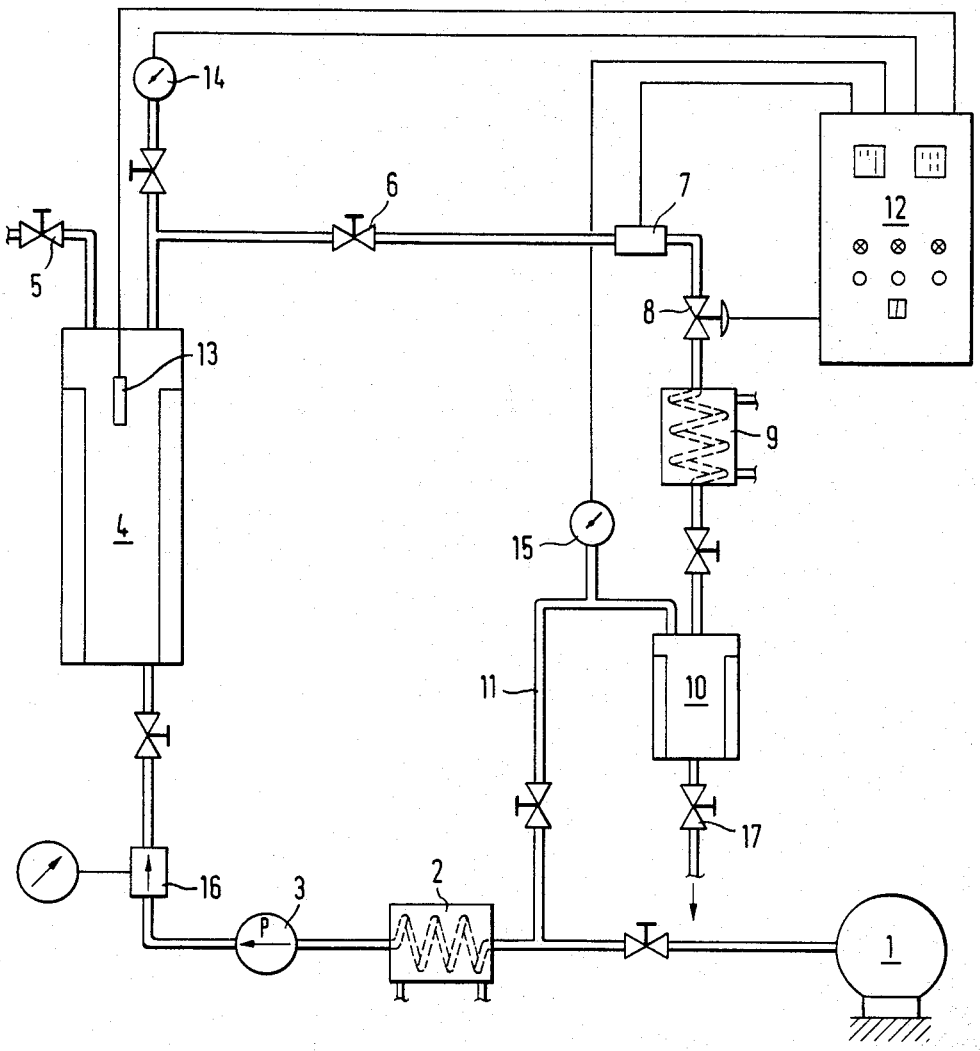
14
6
7
12
5
8
13
9
4
15
11
10
17
16
3
2
1

CLEAR TOBACCO AROMA OIL, A PROCESS FOR OBTAINING IT FROM A TOBACCO EXTRACT, AND ITS USE

DESCRIPTION

The invention relates to a new product which is a clear tobacco aroma oil which is free of polyphenols, resins and waxes and has a reduced (lowered) nicotine content of 5 to 50% relative (relative to the tobacco from which the tobacco aroma oil originates) and which has the tobacco smell typical of the particular starting tobacco used. The invention also relates to a process for separating clear tobacco aroma oil from a tobacco extract and its use in accordance with the patent claims.

In manufacturing tobacco goods, the aromatization of the tobacco plays an important role. Attempts to isolate, in part or completely, from highly aromatic tobaccos or tobacco wastes, the tobacco aroma oil typical of the particular tobacco in order to add it to different, weakly aromatic tobaccos of the same provenience were hitherto unsuccessful because it proved impossible to isolate an absolute (clear) tobacco aroma oil free of resins and waxes and having a reduced nicotine content.

DE-OS No. 2,128,779 describes a process for isolating aromatic materials and the conversion of the aroma precursors of tobacco, in which the tobacco is extracted with one or more solvents which, in the eluotropic series, reside between trichloroethylene and ethyl acetate, and the aroma precursors from the isolated extract are activated by means of a heat treatment between 110° and 180° C. The aroma products isolated in this process are a wax-like and resinous mass and contain all waxes and resins as well as polyphenols and almost the entire nicotine of the starting product.

DE-OS No. 2,142,205 describes a process for the selective and aroma-preserving extraction of nicotine from tobacco, in which, in the first stage, the aroma is removed from the dried tobacco by treatment with dry, supercritical gases (for example $CO_2$) and then temporarily stored in a separating vessel B until the nicotine, which is then deposited in vessel D, has been extracted from the tobacco in vessel A in a second process stage using moist $CO_2$. In a third process stage, the aromatic materials present in vessel B are dissolved with, for example, supercritical $CO_2$, returned to vessel A and deposited there on the tobacco.

This process is expensive and of low efficiency in respect of the isolation and utilisation of the tobacco aroma, since the product obtained in the first stage is not a clear liquid tobacco aroma oil which can be separated from resins and waxes but a paste which includes almost all undesirable waxes and resins of the starting product as well as undesirable polyphenols. In addition, these waxy and resinous materials prevent uniform distribution and aroma transfer in the re-aromatization of a tobacco to be treated. Among other disadvantages the polyphenols impair smoke flavor.

DE-OS No. 2,844,781 describes a process for the extractive treatment of vegetable and animal material, inter alia, also the processing of tobacco, using a solvent which consists of two components, such as, for example, 93 mole percent of $CO_2$+7 mole percent of ethanol or 94 mole percent of $CO_2$+6 mole percent of butane. The purpose of the two-phase mixture is, for example, to avoid the adducts formed in the organic solvent extraction and changes in the processed material. Working with $CO_2$ alone under supercritical pressure conditions is said to require pressures of over 150 bar in order to obtain adequate degrees of extraction. The process of DE-OS No. 2,844,781 is said to avoid these disadvantages by adding certain amounts of, for example, alcoholic solvents as entraining agents to the $CO_2$ use for the extraction.

This process, like the process of DE-OS No. 2,142,205, produces as an intermediate product only a pasty substance containing few aromatic materials but all wax and resin fractions as well as undesirable polyphenols of the tobacco used for the extraction.

In none of the known processes was it possible to obtain a tobacco extract or tobacco aroma which has the tobacco smell typical of the particular starting tobacco used.

It is an object of the present invention to isolate a clear and absolute tobacco aroma oil which, qualitatively and quantitatively, contains almost all aromatic materials of the starting product, is free of resins, waxes and polyphenols and the nicotine content of which is—compared to the starting product—greatly reduced.

This object is achieved by the process in accordance with the patent claims.

Since the known processes for extracting tobacco with organic solvents or for extracting tobacco with supercritical gases, such as, for example, $CO_2$, have always produced only a paste-like aroma product containing almost all resins and waxes as well as polyphenols of the starting material, it is surprising that a primary extraction with organic solvents or mixtures of these solvents with one another or with carbon dioxide and a downstream secondary extraction with $CO_2$ produce a two-phase resin/aroma oil mixture which can easily be separated into a clear tobacco aroma oil and a solid resin/wax mixture without aroma compound.

The invention is illustrated in more detail below.

Within the scope of the present invention tobacco is fermented tobacco leaves, stalks, stems or dust as well as tobacco waste.

Within the scope of the present invention a tobacco primary extract is an extract prepared with customary organic solvents, in particular benzene, toluene, methanol, ethanol, n-propanol, methylethyl acetate, diethyl ether, acetone, n-propane, n-hexane, cyclohexane, petroleum ether, dichloromethane or trichloromethane or with mixtures of these solvents. Within the scope of the present invention a primary extract is also a $CO_2$ extract, i.e. an extract prepared using $CO_2$ as the solvent.

Within the scope of the present invention adsorbents are all customary adsorbents, in particular activated carbon, alumina, magnesium oxide, sodium aluminosilicate, bleaching earth, bentonite, silica gel, kieselguhr, zeolitic molecular sieves and the like.

Within the scope of the present invention a tobacco aroma oil is a tobacco-aromatic, oily liquid which is absolutely clear at normal temperature and is free of resins and waxes, is free of polyphenols, has a reduced nicotine content of 5 to 50% relative (in particular 10 to 40% relative), relative to the tobacco from which the tobacco extract originates, and which does not become turbid or produce a precipitate on adding aqueous ethanol (containing 95% by weight ethanol).

The preparation of the tobacco primary extract used according to the invention consists in detail in extracting the tobacco in one of the abovementioned solvents or (in the case of organic solvents) in a solvent mixture.

Preferably 1 part by weight of precomminuted tobacco is extracted with about 3 to 30 parts by weight of one of the solvents mentioned (preferably $CO_2$, n-hexane or dichloromethane). Depending on the efficiency of the extracting equipment present, the primary extraction is carried out for at least 10 minutes and at most 10 hours, preferably for 1 to 5 hours.

If organic solvents are used the primary extraction is carried out under normal pressure conditions. If $CO_2$ is used in the primary extraction the pressure and temperature conditions in the extraction vessel and separating vessel and extraction time and $CO_2$ flow rate are identical to those which are indicated below in connection with the (one-stage) secondary extraction (cf. page 10, line 24 to page 11, line 11 and page 12, line 10 to page 13, line 4).

The undissolved residue in the treatment with these solvents is separated off, and the solvent-containing extract is concentrated by evaporating until a sirupy solvent-free tobacco extract is obtained. If organic solvents are used the evaporating preferably takes place under vacuum, particularly preferably under about 15 mmHg. If $CO_2$ is used the evaporating is effected in the separating vessel, as already mentioned above, under the pressure and temperature conditions indicated below for the (one-stage) secondary extraction.

A tobacco primary extract obtained in this way contains, inter alia, polyphenols, resins/waxes and nicotine, and, as the inventor has found, is in an easily accessible form which is particularly suitable for the subsequent secondary extraction (with $CO_2$).

The tobacco primary extract obtained is then thoroughly mixed according to the invention with an adsorbent until there exists a uniform distribution between extract and adsorbent. Adsorbents which are particularly preferred for this step are sodium aluminosilicate, bentonite, magnesium oxide and zeolitic molecular sieves. The mixing ratio of extract to adsorbent is variable and can be adjusted to suit the consistency of the extract, the density and particle size of the adsorbent and the desired consistency of the result of the mixing. Generally, a mixing ratio of extract to adsorbent between 1:0.1 to 1:10 is adequate; a pulverulent extract mixture having a mixing ratio of extract to adsorbent of 1:0.3 to 1:6 is preferred.

The extract/adsorbent mixture should not fall below a ratio of 1:0.1, since the adsorbent used according to the invention has a critical influence on the dissolving of the aromatic materials in the subsequent secondary extraction with $CO_2$ (in the extraction vessel) and the separation, in the separating vessel, of clear absolute tobacco aroma oil which can readily be separated from resins and waxes.

A mixing ratio of more than 1:10 also still produces good dissolving and separating of the tobacco aroma oil, but a larger pressure vessel volume has to be accepted.

The mixture of primary extract and adsorbent is treated according to the invention in a first pressure vessel (extraction vessel), preferably a high pressure vessel, with $CO_2$ under certain pressure and temperature conditions until all aromatic materials are present in the second pressure vessel (separating vessel) downstream of the extraction vessel as an oily liquid which can easily be separated from resins and waxes.

This secondary extraction with $CO_2$ according to the process of the invention is achieved by keeping the $CO_2$ used for extracting the extract/adsorbent mixture supercritical in respect of pressure and temperature (>73 bar and >31.3° C.) or subcritical in respect of pressure and temperature (<73 bar and <31.3° C.) or supercritical in respect of pressure (>73 bar) and subcritical in respect of temperature (<31.3° C.).

When working under supercritical conditions in respect of pressure and temperature pressures of 85 to 250 bar and temperatures of +35° C. to +90° C. are preferably chosen. When working in the subcritical pressure and subcritical temperature range pressures of 25 to 70 bar and temperatures of +5° C. to +25° C. are preferable. When working in the supercritical pressure and subcritical temperature range pressures of 85 to 200 bar and temperatures of +10° C. to +30° C. are preferable.

If a particularly low nicotine content in the final product (secondary extract) is desired (for example of 5 to 10% relative, relative to the tobacco used for the primary extraction), an additional $CO_2$ extraction step at low temperatures can be inserted between the primary extraction as claimed and the secondary extraction as claimed. For this purpose, the extract obtained in the primary extraction and mixed with the adsorbent is treated above all at $CO_2$ extraction temperatures of −25° C. to +5° C. and under $CO_2$ extraction pressures of about 20 to 25 bar; in this inserted $CO_2$ extraction step, the separating vessel is let down under subcritical pressure and temperature conditions, a separation (of the nicotine) in the separating vessel at temperatures of about +15° C. to +30° C. and under pressures of about 2 to 15 bar being preferable. An extraction time of 0.5 to 2 hours, preferably about 1 hour, and a $CO_2$ flow rate of 5 to 50 kg/hour, preferably 10 to 30 kg/hour, are sufficient in this step. Surprisingly, this inserted $CO_2$ extraction step dissolves almost exclusively nicotine and other secondary alkaloids (but not other constituents which are in themselves $CO_2$-soluble, such as, for example, aromatic materials, resins, waxes, polyphenols and the like) out of the primary extract/adsorbent mixture and deposits these materials in the separating vessel. The nicotine obtained is removed from the separating vessel before the subsequent secondary extraction (aroma extraction) with $CO_2$ begins.

In the process according to the invention as claimed in the patent claim, in particular in the secondary extraction, the separation conditions in the expansion vessel (separating vessel) are critical for the quality and quantity of the product isolated according to the invention. The expansion pressures and expansion temperatures are advantageously within the subcritical range of $CO_2$ (subcritical pressure/subcritical temperature). Pressures of 45 to 65 bar and temperatures of 15° to 30° C. are preferable; pressures of about 50 to 55 bar and temperatures of 20° to 25° C. are particularly preferable. The separation in the expansion vessel is preferably carried out with a simultaneous reduction in pressure and temperature relative to the pressure and temperature conditions prevailing in the extraction vessel.

The amount of the $CO_2$ flowing through the extraction vessel and the length of time for the flow treatment are also critical for the procedure according to the invention. Total treatment times of 0.5 to 8 hours, preferably 1 to 5 hours and particularly preferably 2 to 4 hours, are advantageous; an overall $CO_2$ flow rate of 0.3 to 35 kg/hour, preferably 3 to 30 kg/hour and particularly preferably 5 to 15 kg/hour, relative to 1 kg of untreated tobacco, is advantageous.

As already mentioned above (cf. page 8, line 28 to page 9, line 4), the $CO_2$ extract conditions indicated above for the (one-stage) secondary extraction, such as pressure and temperature in the extraction vessel, pressure and temperature in the separating vessel, extraction time and $CO_2$ flow rate, also apply to the primary extraction if it uses $CO_2$ as the solvent. Accordingly, it is not necessary to list these parameters once more specifically for the case of the primary extraction.

In the process according to the invention, a solid/oil mixture which is already in 2 phases is obtained on removal from the expansion vessel when the secondary extraction has ended. Simple filtration can separate this mixture into a clear and absolute tobacco aroma oil, free of polyphenols and having a greatly reduced nicotine content and a solid resin/wax mixture having a relatively high nicotine content.

Another particular characteristic of the tobacco aroma oil isolated according to the invention is that it has the tobacco smell typical of the particular starting tobacco used. This property clearly distinguishes it from any existing tobacco extracts, since it was impossible with any of the conventional tobacco extracts to prepare the typical smell of the particular starting tobacco. Owing to this characteristic feature of the tobacco extract isolated according to the invention it can be assumed that its material composition is completely novel relative to the state of the art.

Starting from a product (tobacco primary extract) which contains added at one and the same time aromatic materials, polyphenols, nicotine, resins, waxes and other materials, the present invention achieves for the first time separation and isolation of the tobacco aroma as a clear and absolute oil, with measures simple to carry out and a particularly efficient result. The state of the art contains no indication for this process as such or for the product obtained.

It is remarkable and surprising in the product isolated according to the invention that, after the secondary extraction has ended, a clear layer of tobacco aroma oil which can be easily separated, has a greatly reduced nicotine content and is free of polyphenols, resins and waxes and a resinous/waxy layer which includes a significant proportion of the nicotine of the primary extract, can be removed from the expansion vessel.

It was surprising that the tobacco ingredients which are isolated by primary extraction in the procedure according to the invention behave completely differently in the mixture with a pulverulent adsorbent and the subsequent secondary extraction (with $CO_2$) in respect of their viscosity and their solubility and separating behavior than the same ingredients which are only subjected to the primary extraction (even the $CO_2$ primary extraction), for example of tobacco leaves.

This fact also becomes very clear in the case of the particularly efficient nicotine extraction optionally inserted according to the invention (optionally inserted $CO_2$ extraction step): according to existing teaching, nicotine and polyphenols are only extracted, for example from tobacco leaves, with the aid of $CO_2$, only in the presence of moisture. However, the procedure according to the invention does not add or use moisture in any process stage, but, nevertheless, almost the entire nicotine is dissolved out of the primary extract prepared according to the invention and deposited in the separating vessel. This new insight also results in the process varient according to the invention where (if desired) almost pure nicotine is selectively extracted from the primary extract/adsorbent mixture by (dry) $CO_2$ extraction at temperatures of $-25°$ C. to $+5°$ C.

A further surprise is the yield and purity of the smell of the product prepared according to the invention and its smoke flavor-improving effect.

Little has hitherto become known specifically about the aroma oil of tobacco. Aroma oils isolated in the conventional manner have merely been prepared on laboratory scale by means of steam distillation. The oils obtained were accompanied by numerous foreign smells, such as, for example, camomile, caraway, peppermint, valerian and amyl alcohol, which are probably caused by the formation of artefacts. The yield of such tobacco oils was about 0.1 to 0.2%.

As already mentioned above, there is a clear difference between these tobacco oils and the tobacco aroma oil which is isolated according to the invention and which has the pure smell typical of the particular starting tobacco used. Thus, for example, the aroma oil isolated from Havana tobacco smells of Havana tobacco, while aroma oil isolated from Kentucky tobacco smells of Kentucky tobacco. Similarly, aroma oils isolated from Virginia, Turkish or Burley tobacco have the pure smell highly typical of the particular kind of tobacco. Because of this special characteristic, which clearly differs from the state of the art, it may be stated that the tobacco aroma oil isolated according to the invention is completely novel, in its material composition, relative to the products of the state of the art.

Tobacco aroma oil isolated by the method according to the invention is free of foreign smells, is free of polyphenols, resins and waxes, has a reduced nicotine content, which is only 5 to 50% relative to the tobacco leaves used, and is obtained in yields of 0.8 to 2.5% (absolute oil).

In respect of the yield on aromatizing tobacco, just 50 ppm of the product isolated according to the invention, for example from Havana tobacco, have the same yield and intensity in aroma as about 250 ppm of an aroma product isolated from Havana tobacco by known steam distillation methods.

The invention also relates to the use of the tobacco aroma oil isolated according to the invention for aromatizing tobacco or tobacco products, not only by direct application to tobacco but also by aromatizing porous carrier material or tobacco adhesive material.

In the case of direct application to tobacco, the tobacco aroma oil according to the invention is suitable not only for aromatizing weakly aromatic tobaccos or reconstituted tobaccos by means of sauces (casing) but it is also particularly suitable for use as a top flavor.

Another method of aromatizing consists in applying the tobacco aroma oil to porous carrier materials which are in contact with tobacco or tobacco products. Such porous carrier materials can be, for example, in the form of pieces of paper or clay, dummies or internal packaging material (for example in packets, bags and the like).

Another way of aromatizing using the tobacco aroma oil according to the invention, and which may also be mentioned, is the addition to adhesive material for tobacco products. Examples are adhesive materials of the type customarily used for tobacco products, for example adhesives for cigar wrappers, cigarette paper and the like.

The tobacco aroma oil isolated according to the invention makes it possible to affect critically any fluctuations (quality differences or other differences in the smoke flavor) in the tobacco which may arise in the production.

The amount of tobacco aroma oil used for aromatizing tobacco or tobacco products can vary according to the properties of the tobacco and the degree of aromatization desired. In the case of aroma oil isolated according to the invention from, for example, Havanna tobacco, preferably 25 to 100, particularly preferably 40 to 60, mg of tobacco aroma oil per kg of tobacco, i.e. 25 to 100 ppm, preferably 40 to 60 ppm, are used for application.

The high yield and intensity which can be achieved with the product according to the invention is particularly enhanced by the fact that the tobacco aroma oil is free of resin, polyphenol and wax. This particular property of the tobacco aroma oil is also a feature which, compared to the state of the art, is particularly characteristic and novel.

Below, a device which is particularly suitable for carrying out the secondary extraction according to the invention is described (cf. attached drawing): Liquid $CO_2$ is taken in a subcritical pressure and temperature state from tank 1. The heat exchanger 2 adjusts the $CO_2$ to the subcritical or supercritical temperature desired, and the supercritical or subcritical pressure desired is obtained with the aid of the high pressure pump 3. The $CO_2$ passes through the flow meter 16 to the extraction vessel 4, where the extraction of the mixture of primary extract and adsorbent takes place. The extraction vessel 4 is discontinuously filled, and emptied, of product by opening and closing the top opening after each extraction. The pressure prevailing in the extraction vessel is determined with the pressure gauge 14. The liquid or gaseous $CO_2$, which contains the dissolved tobacco ingredients, is passed via the butterfly valve 6 to the pressure control valve 8 (=expansion valve) and is introduced into the expansion vessel 10 via the heat exchanger 9. The splitting of the tobacco ingredients dissolved in the $CO_2$ is initiated by the pressure control valve 8 and supported by lowering the temperature in the heat exchanger 9. The extracted tobacco constituents separate in the expansion vessel 10 into a clear tobacco aroma oil and a waxy, resinous nicotine product, which are removed either continuously through the valve 17 or after the extraction has ended by opening the vessel 10. At the end of each extraction the extraction side of the device is also let down by opening the valve 5. The $CO_2$ which exists from the expansion vessel 10 during the extraction is recirculated via the line 11. The device can be controlled by hand or by means of the electrical control instrument 12, which has as inputs the temperature measured in the extraction vessel 4 by means of a thermocouple 13, the pressures measured with the pressure guages 14 and 15, the $CO_2$ flows which exit from the pressure vessels 4 and 10 and the flow rate measured with the flow meter 7. The pressure control valve 8 and also the cooling performance in the heat exchanger 9 are adjusted as a function of these measured values.

If $CO_2$ is used as the solvent in the primary extraction as claimed, the device described and illustrated in the drawing can also be used in this step.

The examples which follow illustrate the invention without restricting its application.

The nicotine was determined by spectrophotometric means, in accordance with the method of H. Kuhn known from "Handbuch der Lebensmittelchemie [Handbook of Food Chemistry]" Volume VI, (1970), pages 321 to 325.

EXAMPLE 1

1,000 g of Havana tobacco (water content: 6.5%, and nicotine content: 1.27%) are comminuted in a blade mill and exhaustively extracted in 10 liters of dichloromethane, and the solvent is evaporated off under a vacuum of 15 mmHg.

75 g were obtained of a solvent-free, dark, sirup-like dichloromethane extract (primary extract) which was thoroughly mixed in a kneading machine with 90 g of Na aluminosilicate (Na Al zeolite) (mixing ratio: 1:1.2).

The mixture was treated with $CO_2$ for 120 minutes in a sealed high pressure extraction vessel under a pressure of 230 bar and at a temperature of 65° C. The pressure on the expansion side was 50 bar, and the temperature was 24° C.

The $CO_2$ flow rate is 6 kg/hour.

When the experiment had ended, 40.1 g of a two-phase mixture were removed from the expansion vessel and separated by simple filtration into 22.5 g of clear, oily tobacco aroma oil and 17.6 g of a resin/wax precipitate.

The yield of clear, absolute tobacco aroma oil was 2.25% of the tobacco used. The nicotine content was 19.92%, i.e. 35% relative to the nicotine which had been present in the tobacco.

The yield of the resin/wax precipitate was 1.76%. and the nicotine content was 43% absolute, i.e. 60% relative to the nicotine which had been present in the tobacco.

The tobacco aroma oil isolated was free of resins and waxes and produced no precipitate nor turbidity on the addition of aqueous ethanol (containing 95% by weight ethanol).

EXAMPLE 2

1,000 g of Kentucky tobacco (water content: 8.0%, and nicotine content: 1.7%) are comminuted in a cutting mill and extracted with $CO_2$ as the solvent in a $CO_2$ high pressure extraction installation (in accordance with the drawing):

Extraction conditions

Pressure in the extraction vessel: 250 bar
Temperature in the extraction vessel: 40° C.
Pressure in the expansion vessel: 55 bar
Temperature in the expansion vessel: 22° C.
Length of treatment: 3 hours.
$CO_2$ flow rate: 8 kg/hour.

When the extraction has ended, 70 g of a brown and solid paste (primary extract) are taken from the expansion vessel and thoroughly mixed with 140 g of bentonite.

This mixture is subjected to a secondary extraction with $CO_2$ analogously to the conditions mentioned in Example 1.

When the secondary extraction had ended, 38 g of a two-phase mixture was taken from the expansion vessel and separated by pressure filtration (filter pressure: 5 bar) into 29 g of a resin/wax mixture and 9 g of clear tobacco aroma oil.

The tobacco aroma oil isolated was free of resins, waxes and polyphenols and had the smell typical of Kentucky tobacco. When aqueous ethanol (containing 95% by weight ethanol) was added, there was no turbidity.

EXAMPLE 3

1,000 g of Burley tobacco (water content: 7%, and nicotine content: 2.85%) were comminuted in a blade mill and exhaustively extracted in 6 liters of n-hexane, and the solvent used was evaporated without residue under a vacuum of 20 mmHg.

65 g were obtained of a solvent-free, dark, sirup-like primary extract which was thoroughly mixed with 260 g of magnesium oxide (mixing ratio: 1:4).

The mixture was then subjected to an inserted $CO_2$ extraction step, in a sealed high pressure extraction vessel, and only then subjected to the secondary extraction:

1st Stage $CO_2$ extraction temperature: −17° C.
$CO_2$ extraction pressure: 20 bar
Temperature in the expansion vessel: +18° C.
Pressure in the expansion vessel: 8 bar
Length of treatment: 40 minutes
The $CO_2$ flow rate is 25 kg/hour.

When the treatment time is over 25 g of an almost colorless and odorless oil are removed from the expansion vessel. The nicotine content of this oil was 94.1% absolute, i.e. 82.5% relative to the nicotine which had been present in the tobacco.

2nd Stage (secondary extraction)

The same material, still present in the extraction vessel, was further treated by increasing the pressure and temperature, as follows:

$CO_2$ extraction temperature: +15° C.
$CO_2$ extraction pressure: 60 bar
Temperature in the expansion vessel: +20° C.
Pressure in the expansion vessel: 50 bar
Treatment time of the 2nd stage: 200 minutes
The $CO_2$ flow rate was 15 kg/hour.

When the treatment time was over 29.7 g of a two-phase mixture were taken from the expansion vessel and separated by simple filtration into 15.5 g of clear tobacco aroma oil and 14.2 g of a resin/wax precipitate.

The yield of clear tobacco aroma oil was 1.55% of the tobacco used, and the nicotine content was 9.55% absolute, i.e. 5.2% relative to the nicotine which had been present in the tobacco. The tobacco aroma oil isolated was free of resins and waxes and did not produce a precipitate or turbidity on adding aqueous ethanol (containing 95% by weight ethanol).

EXAMPLE 4

1,000 g of Turkish tobacco (Izmir) (water content: 7.2%, nicotine content: 1.45%) were exhaustively extracted in 8 liters of petroleum ether, and the solvent was evaporated without residue under a vacuum of 15 mmHg.

58 g were obtained of a solvent-free, dark, sirup like primary extract which was thoroughly mixed with 23.2 g of kieselguhr (mixing ratio: 1:0.4). The mixture was treated with $CO_2$ for 180 minutes in a sealed high pressure vessel under a pressure of 180 bar and at a temperature of +20° C.

The pressure on the expansion side was 50 bar, and the temperature was +20° C. The $CO_2$ flow rate is 10 kg/hour.

When the experiment had ended, 20 g of a two-phase mixture were taken from the expansion vessel and separated by simple filtration into 12 g of clear, absolute tobacco aroma oil and 8 g of a resin/wax precipitate.

The yield of clear tobacco aroma oil was 1.2% of the tobacco used, and the nicotine content was 23.2% absolute, i.e. 19.17% relative to the nicotine which had been present in the tobacco.

The resin/wax precipitate had a nicotine content of 57.2% absolute, i.e. 31.5% relative to the nicotine which had been present in the tobacco.

The tobacco aroma oil isolated was free of resins and waxes and did not produce a precipitate or turbidity on adding aqueous ethanol (containing 95% by weight ethanol).

EXAMPLE 5

The yield of the tobacco aroma oil isolated according to the invention was demonstrated as follows:

0.14% of clear tobacco aroma oil which did not produce turbidity in aequous ethanol (containing 95% by weight ethanol) was obtained from the same Havana tobacco as used in Example 1 with the aid of known steam distillation methods. Nicotine content of the aroma oil was 0%.

To assess the yield, one experiment (experiment A) consisted in spraying 200 mg and another experiment (experiment B) consisted in spraying 250 mg, of this aroma oil in an ethanol solution onto 1 kg, in each case, of previously de-aromatized tobacco. In a further experiment (experiment C) 50 mg of the tobacco aroma oil isolated as in Example 1 according to the invention and dissolved in a solution of ethanol were also sprayed onto 1 kg of previously de-aromatized tobacco.

A sensory comparision had the following result:

the tobacco of experiment A this was conspicuous by its low aroma intensity, and it was also not very emphatic in its smoke flavor in respect of its entire aroma;

the tobacco of experiment B it was slightly more emphatic in aroma, accompanied by foreign smells, and an unfavorable burning sharpness was also detected in the smoke flavor; and the tobacco of experiment C it had an intense and pure rounded aroma without foreign smell and was highly appetizing in its smoke flavor. Tobacco C was clearly preferred, and is most suitable for aromatizing.

I claim:

1. A process for obtaining aromatic materials from a tobacco extract, which comprises mixing a tobacco extract, which is obtained by extraction of tobacco with a solvent (primary extract), with an adsorbent, subjecting this mixture to a secondary extraction with $CO_2$ in a sealed pressure vessel (extraction vessel), and isolating in a second sealed pressure vessel (separating vessel) a clear tobacco aroma oil which can readily be separated from resins and waxes and has a reduced nicotine content.

2. A process according to claim 1, wherein the solvent used for preparing the primary extract is benzene, toluene, methanol, ethanol, n-propanol, methylethyl acetate, diethyl ether, acetone, propane, n-hexane, cyclohexane, petroleum ether, dichloromethane, trichloromethane or mixtures of these solvents or carbon dioxide.

3. A process according to claim 1, wherein the adsorbent used in the secondary extraction is magnesium oxide, activated carbon, alumina, sodium aluminosilicate, bleaching earth, bentonite, silica gel, kieselguhr or zeolitic molecular sieves.

4. A process according to claim 1, wherein the ratio of primary extract to adsorbent is from 1:0.1 to 1:10.

5. A process according to claim 1, wherein the secondary extraction with $CO_2$ in said extraction vessel is carried out under supercritical pressure and temperature conditions, under subcritical pressure and temperature conditions or under supercritical pressure and subcritical temperature conditions.

6. A process according to claim 1, wherein the separating vessel is at subcritical pressure and temperature conditions during the secondary extraction with $CO_2$.

7. A process according to claim 1, wherein a tobacco aroma oil is isolated having a nicotine content of 5 to 50% of the nicotine content of said tobacco.

8. A process according to claim 1, wherein to reduce the nicotine content in the tobacco aroma oil to 5 to 10% of the nicotine content of said tobacco, the secondary extraction with $CO_2$ is carried out in two stages:

a. a first extraction stage with $CO_2$ at a temperature of −25° C. to +5° C. under a pressure of about 20 to 25 bar in the extraction vessel, and b. a second extraction stage with $CO_2$ by subsequently increasing the pressure and temperature in the extraction vessel to more than 25 bar and more than 5° C.

9. A process according to claim 8, wherein the separating vessel is held under subcritical pressure and temperature conditions.

10. A process according to claim 1, wherein the secondary extraction with $CO_2$ is carried out for 0.5 to 8 hours.

11. A process according to claim 1, wherein $CO_2$ in the secondary extraction is used at a rate of 0.3 to 35 kg/hour per kg of said tobacco.

12. A process according to claim 1, wherein the product isolated in the secondary extraction in the separating vessel is separated by filtration into resins and waxes on the one hand and clear tobacco aroma oil on the other hand.

13. A process according to claim 8, wherein the product isolated in the secondary extraction in the separating vessel is separated by filtration into resins and waxes on the one hand and clear tobacco aroma oil on the other hand.

14. Clear tobacco aroma oil, obtained from tobacco, essentially free from polyphenols, resins and waxes, and having a nicotine content of 5 to 50% by weight of the nicotine content of said tobacco.

15. The oil according to claim 14, having the tobacco smell typical of said tobacco.

16. A composition comprising the tobacco aroma oil obtained according to claim 1, and a material selected from the groups consisting of tobacco, tobacco products, carrier materials for tobacco or tobacco products and tobacco adhesive materials.

17. A composition comprising the tobacco aroma oil according to claim 14, and a material selected from the group consisting of tobacco, tobacco products, carrier materials for tobacco or tobacco products, and tobacco adhesive materials.

* * * * *